United States Patent [19]

Scott

[11] 4,042,014

[45] Aug. 16, 1977

[54] MULTIPLE STAGE CEMENTING OF WELL CASING IN SUBSEA WELLS

[75] Inventor: Lyle Burnell Scott, Sun City, Calif.

[73] Assignee: BJ-Hughes Inc., Long Beach, Calif.

[21] Appl. No.: 684,808

[22] Filed: May 10, 1976

[51] Int. Cl.[2] ..... E21B 7/12

[52] U.S. Cl. ..... 166/.5; 166/154; 166/193

[58] Field of Search ..... 166/153, 154, 155, 156, 166/289, 291, 193, 194, .5

[56] References Cited

U.S. PATENT DOCUMENTS

| | | | |
|---|---|---|---|
| 2,738,011 | 3/1956 | Mabry | 166/144 |
| 3,364,996 | 1/1958 | Brown | 166/155 X |
| 3,545,542 | 12/1970 | Scott | 166/155 |
| 3,605,896 | 9/1971 | Perkins | 166/154 |
| 3,616,850 | 11/1971 | Scott | 166/155 |
| 3,730,267 | 5/1973 | Scott | 166/291 X |
| 3,789,926 | 2/1974 | Henley | 166/154 X |
| 3,811,500 | 5/1974 | Morrisett et al. | 166/154 |
| 3,915,226 | 10/1975 | Savage | 166/153 |
| 3,948,322 | 4/1976 | Baker | 166/289 |

*Primary Examiner*—Ernest R. Purser
*Assistant Examiner*—Richard E. Favreau
*Attorney, Agent, or Firm*—John O. Evans, Jr.

[57] ABSTRACT

A method and apparatus for multiple stage cementing of well casing in subsea wells. Also, a subsea stage cementer, plug stack assembly. The combination with a subsea stage cementer, plug stack assembly of a packing and shipping crate therefor. A trip-plug for operating a stage cementing collar to open the ports thereof. A dart adapted to enter the bore of a hollow plug to block the flow of liquid through the bore.

28 Claims, 20 Drawing Figures

FIG. 1.
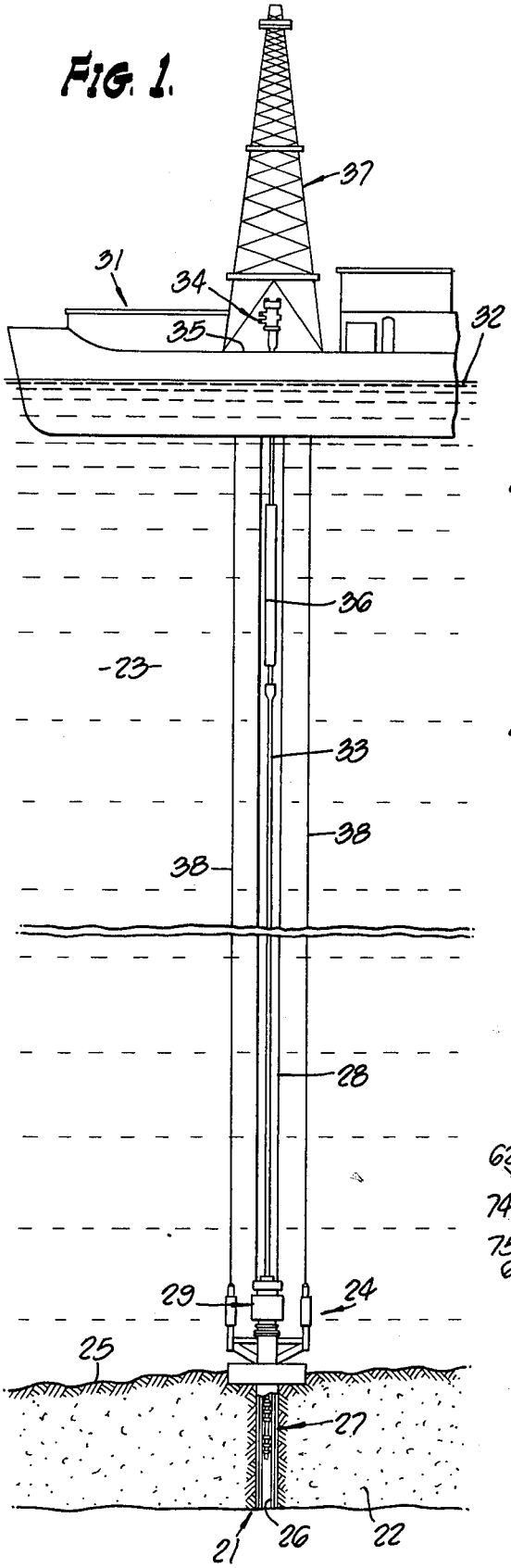
FIG. 2.
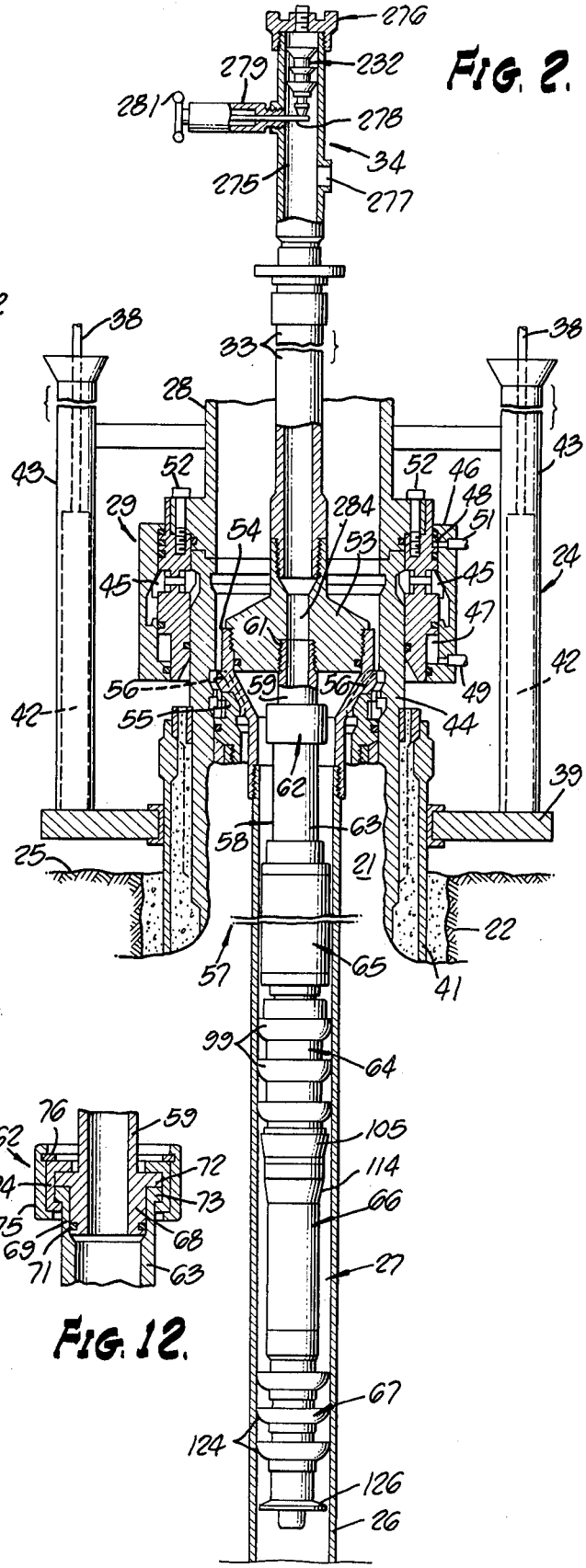
FIG. 12.

MULTIPLE STAGE CEMENTING OF WELL CASING IN SUBSEA WELLS

BACKGROUND OF THE INVENTION

1. Field of the Invention

This invention relates to stage cementing of well casing and the like in subsea wells, especially oil or gas wells. More particularly, the invention pertains to methods of cementing wall casing in subsea and similarly situated wells. Also, the invention includes a subsea well installation for stage cementing well casing in a well. Further, the invention relates to a plug stack assembly for stage cementing a subsea well installation, and to the combination with a plug stack assembly of a protective crate therefor. The invention also relates to an improved trip-plug for operating a stage cementing collar to open the ports thereof. Still further, the invention relates to a dart adapted to enter the bore of a hollow plug to block the flow of liquid through the bore. The invention may also be employed on land based wells.

2. Description of the Prior Art

Heretofore, casing strings have been cemented in well bores in multiple stages. In multiple stage cementing, a first stage or first increment of cement slurry is pumped down the well casing string, out through first stage cementing ports adjacent the bottom of the string, and into the well bore. The slurry rises in the annular space between the casing and the well bore to a predetermined level, and is there maintained in a quiescent condition until it sets. A second stage or second increment of cement slurry is pumped down the casing, out through second stage cementing ports, and into the well bore at a level at or above the top of the column of first stage cement. The second stage of slurry rises in the annulus between the casing and the well bore to a second predetermined level, and is maintained quiescent while setting. Sometimes, a third or even a fourth stage of cement slurry is introduced into the annulus above a preceding stage. The cement bonds the casing to the walls of the well and prevents migration of fluids through the annulus.

Multiple stage cementing has many advantages over single stage cementing, in which but a single charge of cement slurry is deposited around the entire length of casing.

A multiple stage cementing operation reduces the likelihood of breaking down a weak earth formation with the high fluid pressures required to lift a long single column of cement slurry, thus minimizing the loss of slurry to thieving formations. Such a cementing procedure reduces the required pump pressures to magnitudes lower than those needed for a corresponding single stage job.

Multiple stage operations also reduce the length of travel of the slurry in contact with the earth formations surrounding the casing, to thereby reduce contamination of the slurry and insure the strength of the cement when it has cured.

Such multiple stage procedures reduce the quantity of cement required to cement widely separated intervals, as in dual zone wells.

Multiple stage cementing reduces channeling of the cement slurry into drilling mud in the annulus, thereby providing a stronger bond of the cement with the casing and the earth formations.

One previously known system for multiple stage cementing is described in *Composite Catalog of Oil Field Equipment and Services,* 31st Revision (1974–75), published by World Oil, a Gulf Publishing Company Publication, Houston, Texas, U.S.A., 1974, pages 334 to 341. Another such system is described in the foregoing Composite Catalog on pages 2434 to 2440. These known systems employ a casing string having a first-stage cementing port device disposed near the bottom of the string, and a stage collar disposed at an intermediate location in the string. First stage cementing plug structures are used in connection with the first stage cementing port device. Other plugs are used to open and close the ports of the stage cementing collar.

These known systems are practicable for use in cementing casing in the bores of land based wells, where the top of the casing is adjacent to the earth's surface, and the plugs can be launched directly into the top of the casing string. However, these systems are not easily adapted for use in cementing casing in marine based or subsea wells, where the top of the casing terminates at the ocean floor, which may be many hundreds of feet below the surface of the water at which the drilling vessel or platform is located. In those instances, the casing string has to be extended from the ocean floor up to the floating drilling vessel or platform through a riser pipe, so that the plugs can be launched into the casing. The modifications required for adapting these known systems to marine operations are time-consuming and costly.

A subsea well stage cementing system is disclosed in applicant's prior U.S. Pat. No. 3,730,267 issued May 1, 1973. In the system of that prior patent, the top of the casing string terminates at the ocean floor, and fluid connection to the floating or stationary platform at the surface of the water is established through a string of drill pipe. A stage cementing collar is located in the casing string at an intermediate point. A hollow top plug for the first stage of cement slurry is releasably positioned in the casing string below the stage cementing collar. The normally closed stage cementing collar is opened for the second stage cementing operation by dropping an opening-ball into the string of drill pipe and allowing it to drop to the stage collar, and thereafter applying fluid pressure in the casing string above the stage collar. A dart-actuated, hollow top plug for the second stage of cement slurry is releasably secured to a hollow mandrel adjacent to the top of the casing string. This dart-actuated top plug also serves to close the ports of the stage cementing collar after the second stage of cement slurry has been expelled into the annulus in the well bore.

A principal shortcoming of the system of the foregoing prior patent is that, prior to conducting the second stage of cementing, there is no provision for wiping the interior walls of the casing string above the stage collar to remove adherent cement slurry left thereon by the first stage of cement slurry. The time that elapses between the first and second stages of cementing may be such that the adherent cement slurry sets up on the interior walls of the casing, thereby to interfere with subsequent operations. Moreover, the first- and second-stage cementing plugs are mounted in the casing string at widely separated locations, which entails two plug-mounting steps. Also, due to the narrowness of the bore of the string of drill pipe, it is not practicable to drop a trip-plug therethrough to open the stage collar.

SUMMARY OF THE INVENTION

An object of the invention is to provide a method and apparatus for cementing a composite string of well casing in stages within a subsea well bore, wherein the first- and second-stage cementing plugs, as well as the trip-plug for opening the stage collar, are launched from a plug stack assembly in the top of a casing string that may terminate adjacent to the floor of the sea, and wherein the casing string need not be extended to the surface of the sea inside a riser pipe.

Another object is to provide such a method and apparatus wherein the interior walls of the drill pipe and casing string may be wiped substantially completely from top to bottom.

Another object is to provide improved apparatus components for subsea stage cementing.

In its method aspect, the invention resides in a method of cementing a composite string of well casing in stages within a subsea well bore which comprises: lowering into a subsea well bore a composite string of well casing having first-stage cementing port means for communicating the interior of said composite string with the exterior and adapted to be closed by first-stage cementing plug means, and initially closed, but openable and closeable tubular second-stage cementing port means for communicating the interior of said composite string with the exterior, said second-stage cementing port means being disposed above said fist-stage cementing port means and adapted to be opened by trip-plug means and closed by shut-off plug means; suspending said composite string in the well bore from a subsea casing hanger supported by a subsea well head; inserting into said composite string above said second-stage cementing port means a plug stack assembly having tubular first-stage cementing plug means having a wiping fit with the walls of said composite string, tubular trip-plug means above said first-stage cementing plug means, and spaced from the walls of said composite string, means for mounting said first-stage cementing plug means on said trip-plug means in axial alignment therewith, including first releasable means responsive to downward force for releasing said first-stage cementing plug means from said trip-plug means, tubular shut-off plug means above said trip-plug means and having a wiping fit with the walls of said composite string, means for mounting said trip-plug means on said shut-off plug means in alignment therewith, including second releasable means responsive to downward force for releasing said trip-plug means from said shut-off plug means, an annular support member, means for mounting said shut-off plug means on said support member in axial alignment therewith, including third releasable means responsive to downward force for releasing said shut-off plug means from said support member, and said annular support member, said shut-off plug means, said trip-plug means and said first-stage cementing plug means defining a continuous, liquid-tight conduit; mounting said support member against downward movement in said composite string; connecting said support member through a string of drill pipe to cementing equipment adjacent to the surface of the sea above the subsea wellhead for the pumping of liquid through said string of drill pipe, through said conduit, and into said composite string; pumping a first stage of cement slurry followed by a first actuator member and by displacing liquid through said drill pipe, said annular support member, said shut-off plug means, said trip-plug means and said first-stage cementing plug means until said first actuator member engages and plugs the bore of said first-stage cementing plug means; continuing to pump displacing liquid to apply pressure to said first-stage cementing plug means with its bore so plugged to effect its release and displace it down said composite string, through said second-stage cementing port means, and into closing relation with said first-stage cementing port means to thereby displace said first stage of cement slurry out of said first-stage cementing port means into the annulus of the well bore and to block flow of liquid from said composite string through said first-stage cementing port means, and further to support a static column of liquid in said composite string and said drill pipe; inserting a second actuator member into said drill pipe for movement down the drill pipe, through said annular support member and said shut-off plug means until said second actuator member engages and plugs the bore of said trip-plug means; applying liquid pressure above said trip-plug means with its bore so plugged to effect its release; permitting said trip-plug means with its bore so plugged to gravitate down the composite string into port-opening relationship with said second-stage cementing port means, said trip-plug means with its bore so plugged blocking the flow of liquid into the portion of said composite string below said second-stage cementing port means; applying liquid pressure to said trip-plug means with its bore so plugged to open said second-stage cementing port means; pumping a second stage of cement slurry followed by a third actuator member and by displacing liquid through said drill pipe and said annular support member until said third actuator member engages and plugs the bore of said shut-off plug means; continuing to pump displacing liquid through said drill pipe to apply pressure to said shut-off plug means with its bore so plugged to effect its release and displace it down said composite string and into port-closing relation with said second-stage cementing port means and to displace said second stage of cement slurry out of said second-stage cement port means into the well bore; applying liquid pressure to said shut-off plug means with its bore so plugged to close said second-stage cementing port means; and allowing the cement slurry to set in the well bore.

In one of its apparatus aspects, the invention resides in a plug stack assembly insertable into a subsea well casing string for operating cementing ports therein, said stack assembly comprising: a shut-off plug receivable in the well casing string; first releasable means for connecting said shut-off plug to a mandrel inserted in the well casing string, said mandrel having a longitudinal passage for the flow of cementing fluids therethrough; a trip-plug receivable in the well casing string; a second releasable means connecting said trip-plug directly to said shut-off plug; a first-stage cementing plug receivable in the well casing string; third releasable means connecting said first-stage cementing plug directly to said trip-plug; means defining a passage through each plug for the flow of cementing fluids from the longitudinal passage of the mandrel into the well casing string; said first-stage cementing plug having means cooperative with a first closure member in said cementing fluid to close the passage in said first-stage cementing plug and effect release of said third releasable means responsive to cementing fluid pressure; said trip-plug having means cooperative with a second closure member in said cementing fluid to close the passage in said trip-plug and effect release of said second releasable means responsive to cementing fluid pressure; and said shut-off plug having means cooperative with a third closure member in said cementing fluid to close the passage in said shut-off plug and effect release of said first releasable means responsive to cementing fluid pressure.

In another of its apparatus aspects, the invention resides in a subsea well installation including a composite well casing string suspended within a subsea well bore from a casing hanger supported by a subsea well head, said composite well casing string being adapted to be connected through running tool means and a string of drill pipe to hoisting and cementing equipment disposed adjacent to the surface of the sea above the well head; said composite well casing string having first-stage cementing port means for communicating the interior of said composite string with the exterior and adapted to be closed by a first-stage cementing plug; and initially closed, but openable and closeable second-stage cementing port means for communicating the interior of said casing string with the exterior, said second-stage cementing port means being disposed above said first-stage cementing port means and below the top of said casing string and adapted to be opened by a trip-plug and closed by a shut-off plug; a mandrel extending longitudinally into the well casing string and providing a longitudinal passage in fluid communication with the string of drill pipe; a shut-off plug in the well casing string and adapted to close said second-stage cementing port means; first releasable means connecting said shut-off plug to said mandrel; a trip-plug in the well casing string and adapted to open said second stage cementing port means; second releasable means connecting said trip-plug directly to said shut-off plug; a first-stage cementing plug in the well casing string and adapted to close said first-stage cementing port means; third releasable means connecting said first-stage cementing plug directly to said trip-plug; means defining a passage through each plug for the flow of cementing fluids from the longitudinal passage of the mandrel into the well casing string; said first-stage cementing plug having means cooperative with a first closure member in said cementing fluid to close the passage in said first-stage cementing plug and effect release of said third releasable means responsive to cementing fluid pressure to launch said first-stage cementing plug for travel down said casing string to close said first-stage cementing port means; said trip-plug having means cooperative with a second closure member in said cementing fluid to close the passage in said trip-plug to effect release of said second releasable means responsive to cementing fluid pressure to launch said trip-plug for travel down said casing string to open said second-stage cementing port means; and said shut-off plug having means cooperative with a third closure member in said cementing fluid to close the passage in said shut-off plug and effect release of said first releasable means responsive to cementing fluid pressure to launch said shut-off plug for travel down said casing string to close said second-stage cementing port means.

Further, the invention resides in the combination with a subsea stage cementer, plug stack assembly, as described hereinbefore, of a crate having support means cradling the stack assembly and opposing bending stresses or bending and tensile stresses in the stack assembly.

Still further, the invention resides in a trip-plug for operating a stage cementing collar to open the ports thereof comprising: an elongate vertically positionable body providing a liquid passage extending longitudinally therethrough and having a liquid inlet at the upper end and a liquid outlet at the lower end; an actuator member insertable into said liquid passage through said inlet end and cooperable with said body for blocking the flow of liquid through said passage; said actuator member and said body having a high specific gravity adapting them to gravitate through liquid of lower specific gravity disposed above said stage cementing collar.

Moreover, the invention resides in a dart adapted to enter the bore of a hollow plug to block the flow of liquid through the bore which comprises: an elongate body, at least one annular flexible wiping element extending transversely from said body, and an annular flexible sealing member extending transversely from said body and adapted to seal the dart in the bore of a hollow plug to block the flow of liquid therethrough, said at least one wiping element having a diameter larger than the diameter of said sealing member.

Other aims, objects, aspects and advantages of the invention are set forth in or will be apparent from the following detailed description of preferred embodiments taken in connection with the accompanying drawings.

BRIEF DESCRIPTION OF THE DRAWINGS

In the drawings:

FIG. 1 is a vertical sectional view, partly in elevation, of the uppermost part of a marine well, and showing a drilling vessel afloat in the water above the well, important components of the well installation, and exemplary components of cementing equipment in accordance with the invention;

FIG. 2 is a vertical sectional view on a larger scale of a part of the well shown in FIG. 1;

FIG. 12 is an axial sectional view of a swivel component of the cementing equipment.

DESCRIPTION OF THE PREFERRED EMBODIMENTS

Figure 3A:
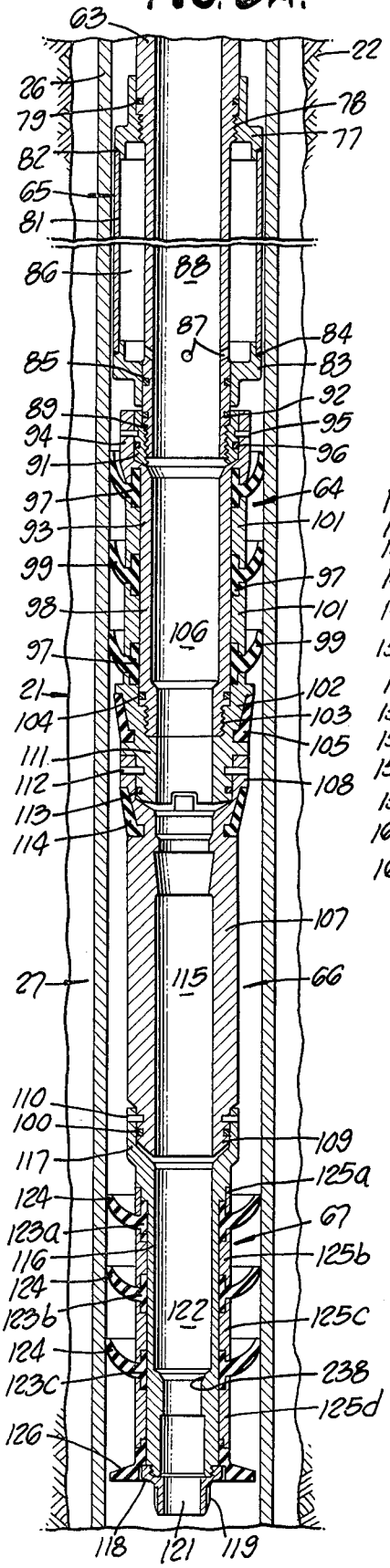
FIGS. 3A, 3B and 3C are, respectively, views of an upper part, an intermediate part, and a lower part of the well of FIG. 1, with certain components of the equipment of the invention installed therein preparatory to the introduction of cement slurry.

Referring to the drawings, particularly to FIG. 1, there is shown a well 21 which has been drilled into the earth 22 beneath the sea 23 or other body of water. A subsea wellhead structure 24 is emplaced on the floor 25 of the sea at the top of the well. Suspended in the well from the well head is a string of well casing 26 having inserted therein a plug stack assembly 27, to be described in detail hereinafter. A riser pipe 28 is connected to the wellhead by a quickly releasable connector 29 and communicates with the casing string through passages in the well head. The riser pipe extends up through the water to a drilling ship or vessel 31 floating on the surface 32 of the sea directly over the wellhead. The riser pipe extends up through an opening or moonhole (not shown) in the ship, and the top (not shown) of the riser pipe is exposed above the waterline and within the vessel. A string of drill pipe 33 extends within the riser pipe 28 upwardly from the connector 29 and terminates at the top in an actuator launching head 34 accessible from the deck 35 of the drilling vessel. A bumper sub 36 is included in the string of drill pipe to compensate for the heaving of the vessel due to wave action. The drilling vessel is equipped with a derrick structure 37. Guide lines 38 extend between the vessel 31 and the wellhead structure 24. The riser pipe 28 may have a blowout preventer stack (not shown) located above and closely adjacent to the quickly releasable connector 29.

Turning now to FIG. 2, it is seen that the wellhead structure 24 generally includes an annular support member 39 which is affixed to the upper end of an outer casing 41 and has vertically extending guide posts 42 slidably receiving guide tubes 43 which are guided on the lines 38, previously described. The riser pipe 28 is secured to a wellhead body 44 by the previously mentioned connector 29. This connector is well-known and includes releasable latch dogs 45 shiftable to inner positions to secure the connector 29 on the wellhead body 44 in response to movement of an annular latch piston 46 downwardly, the latch dogs 45 being releasable upon upward movement of the latch piston 46. Piston chambers 47 and 48 are provided and are adapted to be pressurized through respective conduits 49 and 51 to shift the piston upwardly and downwardly, as desired. The riser pipe 28 is connected to the quickly releasable connector 29 by fasteners 52.

A universal running tool 53 is threadedly connected to the lower end of the drill string 33, and a casing hanger body 54 is threaded to the running tool. The well casing string 26 is threadedly fastened to the bottom of the casing hanger body 54. The casing string 26 is run into the well on the drill pipe string 33 until the casing hanger body 54 lands upon a casing hanger 55 supported by the wellhead body 44. Grooves 56 are provided in the casing hanger 55 to allow circulation of fluids from the annulus 57 below the casing hanger body 54 into the riser pipe 28 thereabove.

The wellhead structure described hereinbefore is conventional and needs no further detailed description herein.

As best seen in FIG. 2, a plug launching mandrel 58 depends from the universal running tool 53. This mandrel has an upper mandrel section 59 connected to the running tool by threads 61. At its lower end, the mandrel section 59 connects with a swivel, designated by the general reference numeral 62, to be described in detail hereinafter with reference to FIG. 12. A lower mandrel section 63 extends downwardly from the swivel 62 and is connected at its bottom end to a shut-off plug 64. A surge chamber 65, also to be described hereinafter, surrounds the lower mandrel section 63 between the shut-off plug 64 and the swivel 62. At the bottom of the shut-off plug there is connected a trip-plug 66, which, in turn, carries a first-stage cementing plug 67. These three plugs will be described more fully hereinafter, but it is here remarked that these plugs are received within the top portion of the well casing string 26.

Referring to FIG. 12, the swivel 62 connects the upper mandrel section 59 to the lower mandrel section 63 to permit relative rotation of the two sections about their common longitudinal axis, so that the universal running tool 53 can be screwed into the casing hanger body 54 without rotating the plugs 64, 66 and 67 in the casing string 26. For this purpose, the upper mandrel section 59 has a lower cylindrical end 68 rotatably received within an upwardly extended end 69 of the lower mandrel section 63. Suitable seal means 71 may be provided between the mandrel section ends 68 and 69. The swivel means further includes outturned flanges 72 and 73 on the respective mandrel sections 59 and 63, these flanges being held together for relative rotation by a split, channeled ring 74, which is retained in place by a collar 75 held in place by a snap ring 76.

The surge chamber 65 is shown in cross section in FIG. 3A, to which reference is now made. The surge chamber has an upper head 77 that is threaded to the lower mandrel section 63 by thread means 78. An O-ring seal 79 provides a static seal between the upper head 77 and the lower mandrel section 63. A cylindrical body portion 81 is welded at 82 to the upper head 77. A lower head 83 is welded at 84 to the bottom of the body portion 81 and is sealed to the lower mandrel section 63 by another O-ring seal 85. The upper and lower heads and the cylindrical body portion cooperate with the lower mandrel section to provide an annular space 86. This annular space is in fluid communication through ports 87 with the bore 88 of the lower mandrel section. The ports slope downwardly and inwardly and are located at the bottom of the annular space 86 to permit liquid to drain from the annular space into the bore of the lower mandrel section.

The bottom of the lower mandrel section 63 has exterior threads 89 to which a bushing 91 is secured by mating interior threads. An O-ring seal 92 seals the bushing to the lower mandrel section.

Figure 7:
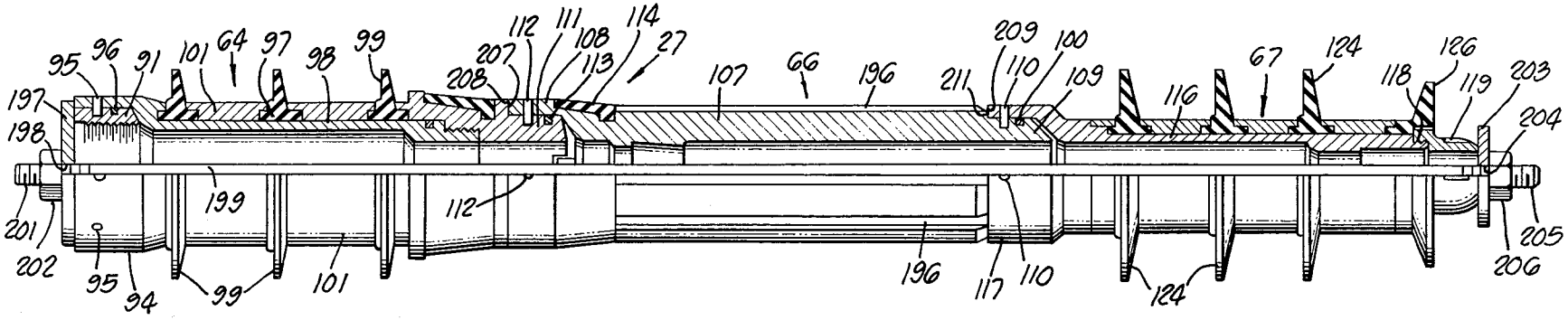
FIG. 7 is an enlarged, quarter-sectional view of a plug stack assembly in accordance with the invention.

As best seen in FIGS. 3A and 7, the shut-off plug 64, previously referred to, has an inner body 93 with an upstanding bell 94 of enlarged diameter that surrounds the bushing 91 and has a sliding fit therewith. The bell is releasably secured to the bushing by circumferentially arranged shear pins 95 and is sealed to the bushing by an O-ring 96. A series of longitudinally spaced, rubber cups 97 is mounted on the central part 98 of the inner body 93. The cups have upwardly and outwardly sloped flanges 99 that yieldingly engage the inner wall of the well casing 26. Retainer rings 101 hold the cups and space them along the central part of the body. The uppermost cup 97 is retained in an annular T-slot provided between the bell 94 and the upper ring 101; the middle cup is held in an annular T-slot provided between the upper and lower retainer rings; and the bottommost cup is held in an annular T-slot provided between the lower retainer ring and a nose piece 102. The nose piece is fastened by threads 103 to the bottom of the inner body 93 of the shut-off plug 64, an O-ring 104 being provided to seal the nose piece to the inner body. The nose piece is fitted with a downwardly tapering, rubber sealing ring 105, the purpose of which will be set forth hereinafter. It will be seen that the inner body 93 provides an axial passage 106 that communicates with the bore 88 of the lower mandrel section.

The trip-plug 66, previously referred to and shown to advantage in FIGS. 3A and 7, has a body portion 107 with an upstanding bell 108 of larger diameter and a depending nose portion 109 of smaller diameter. The bell 108 slidably engages a reduced diameter portion 111 of the nose piece 102 of the superjacent shut-off plug 64, and is releasably attached thereto by circumferentially arranged shear pins 112. The bell 108 is sealed to the reduced diameter portion by an O-ring 113. A downwardly tapered sealing ring 114 is mounted on the bell 108 of the trip-plug. The body portion 107 has relatively thick walls that are spaced radially inwardly from the bore of the casing 26 and that provide a central liquid flow passage 115 communicating with the passage 106 in the shut-off plug immediately thereabove.

The first-stage cementing plug 67, previously mentioned and now described with reference to FIGS. 3A and 7, is releasably suspended from the trip-plug 66. The first-stage cementing plug has an inner body 116 with an upstanding bell 117 of enlarged diameter. The bell 117 is slidably fitted on the nose portion 109 of the superjacent trip-plug 66 and is releasably secured thereto by a circular row of shear pins 110. An O-ring 100 seals the bell 117 to the nose portion 109. Threaded at 118 to the bottom of the inner body 116 is a nose piece 119 having an axial opening 121 therethrough. The axial opening 121 communicates fluidically with a bore 122 in the inner body 116, which, in turn, is in fluid communication with the passage 115 in the trip-plug. A plurality, specifically three, elastomeric cups 123a, 123b and 123c are mounted on the inner body 116 of the first-stage cementing plug. The cups have upwardly and outwardly sloped flanges 124 that are in flexible engagement with the inner wall of the casing 26. Cup **123*a* is mounted in an annular T-slot provided between retainer rings 125*a* and 125*b*. Cup 123*b* is similarly mounted between retainer rings 125*b* and 125*c*. In like fashion, cup 123c is mounted between retainer rings 125*c* and 125*d*. A rubber flange number 126 is mounted between the retainer ring 125*d* and the nose piece 119, which is threaded to the inner body 116** and which secures the retainer rings and the elastomeric cups upon the inner body.

Figure 3B:
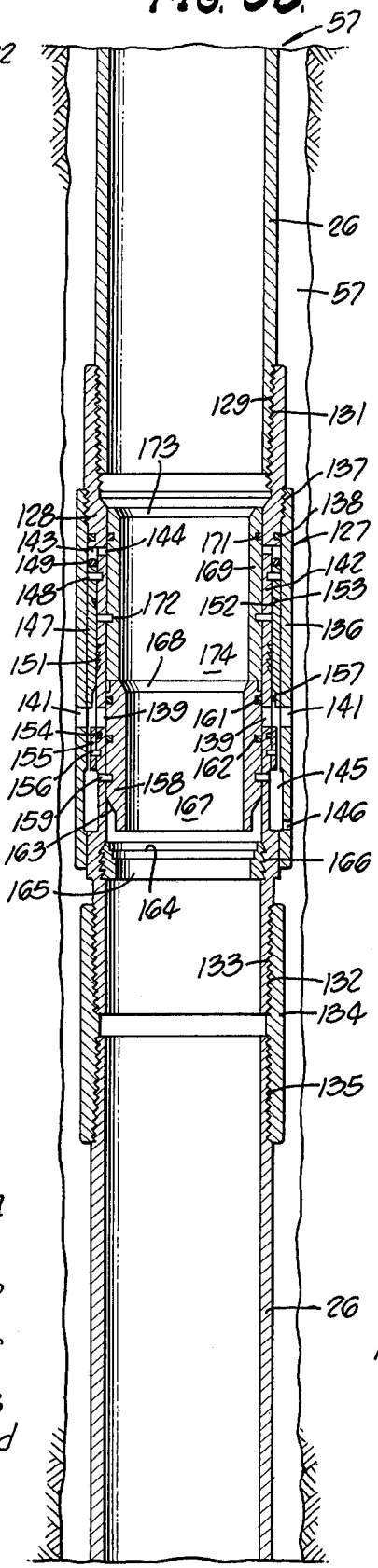

As best seen in FIG. 3B, a stage cementing collar, designated by the general reference numeral 127, is located in the casing string 26 below the plug stack assembly 27 and at the depth where it is desired to introduce the second stage of cement slurry into the annulus 57 between the casing and the wall of the well 21. The stage cementing collar has a tubular body 128, the upper, internal end of which has tapered threads 129 engaged with mating threads 131 on the exterior of the casing 26. The bottom of the body 127 has tapered, external threads 132 that are threaded into the mating threads 133 of a casing collar 134. The casing collar is threadedly coupled at 135 to a lower extension of the casing string 26. Thus, the body 128 of the casing collar provides, in effect, a continuous joint of the casing string. An outer sleeve 136 is secured to the body 127 by threads 137, and is sealed to the body by an O-ring 138. Stage cementing ports 139 are provided in the body 128, and ports 141 are provided in the outer sleeve 136 and arranged in alignment with the ports 139.

The body 128 has a central portion 142 of reduced outer diameter that provides with the outer sleeve 136 an annular cylindrical chamber 143. It is seen that the O-ring 138, previously mentioned, is above the chamber 143 and thus seals the top of the chamber against leakage between the threads 137. Openings 144 extend from the top of the chamber 143 inwardly through the central portion 142 of the body 128. The lower part of the annular chamber 143 is enlarged to form an annular chamber portion 145. A port 146 in the outer sleeve 136 communicates the annular chamber portion 145 with the well-casing annulus 57.

Slidably disposed within the annular cylindrical chamber 143 and above the ports 139,141, is a shut-off sleeve 147. Shear pins 148, circumferentially disposed, releasably secure the shut-off sleeve to the central portion 142 of the body 128. An O-ring 149 is floatingly disposed in the annular cylindrical chamber 143 and on top of the shut-off sleeve 147 to provide a seal between the shut-off sleeve and the walls of the annular chamber. Ratch notches 151 are circumscribed on the outer periphery of the central portion 142 of the body. A split detent ring 152, received in a circumferential groove 153 on the inner periphery of the shut-off sleeve 147, is adapted to spring into engagement with one of the ratch notches 151 when the shut-off sleeve is in a lower position, thereby to hold the shut-off sleeve in said lower position.

Just below the ports 139, an O-ring 154 is positioned in a circumferential groove in the outer surface of the central portion 142 of the body. This O-ring is retained in its groove by a surrounding O-ring retainer sleeve 155 releasably fastened to the central portion 142 by shear pins 156.

The shut-off sleeve has an annular tapered counterbore 157 provided in its bottom portion, for a purpose which will be explained hereinafter.

Slidably mounted within the central portion 142 of the body 128 is lower or port-opening sleeve 158. This sleeve is releasably held by shear pins 159 in a position to close the ports 139. This lower sleeve has circumferential O-rings 161 and 162 positioned, respectively, above and below the ports 139 to seal the sleeve to the central portion 142 above and below the ports. A tapered stop member 163 is provided adjacent to the bottom of the lower sleeve 158. This stop member is adapted to abut the upper, stepped surface 164 of a split stop ring 165 when the lower sleeve 158 moves downwardly, thereby to limit such downward movement. The stop ring 165 is received in a groove 166 in the bore of the body 128. The bore 167 of the lower sleeve is circumscribed at the top by a chamfer 168 which forms a seat for an actuator or trip-plug, which will be described hereinafter.

Immediately superjacent to the lower sleeve 158 an upper or port-closing sleeve 169 is slidably mounted in the body 128. This sleeve carries an O-ring 171 in a groove around its outer surface for sealing the sleeve to the bore of the body. The upper sleeve is releasably pinned to the bore of the body 128 by shear pins 172, and, when the shear pins are broken, is adapted to slide downwardly in the bore of the body. A chamfer 173 circumscribes the top of the vertical passage 174 through the upper sleeve, this chamfer forming a seat for an actuator or shut-off plug, to be described hereinafter.

It will be seen from FIG. 3B that the diameter of the seat or chamfer 168 on the lower sleeve 158 is greater than the diameter of the bore 167 of the lower sleeve, yet less than the diameter of the vertical passage 174 through the upper sleeve 169, which, in turn, has a diameter less than the seat or chamfer 173 of the upper sleeve. The reasons for these diametral relationships will be set forth hereinafter.

The stage cementing collar 27, immediately hereinbefore described, is a subassembly manufactured by Baker Oil Tools, Inc. of Los Angeles, California, and is not per se the invention of the applicant. It is exemplary of the type of stage cementing collar that may be used in the practice of the present invention. It is shown and described in the aforementioned 1974–75 *Composite Catalog* at pages 334—341.

Figure 3C:
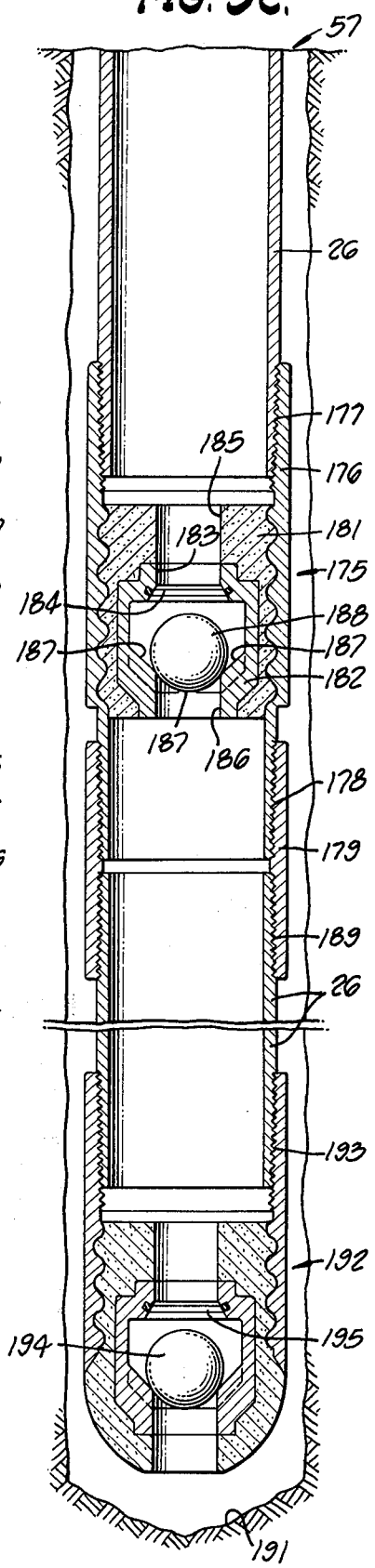

As will be seen from FIGS. 3B and 3C, the casing 26 extends downwardly in the well 21 to a cement float collar 175. This float collar is conventional. It has a tubular body 176 threaded at 177 to the casing 26, and at 178 to a casing coupling 179.

A block of concrete 181 is cast within the body 176 and about a cage 182 to support the cage centrally of the body. The cage has an upper fluid passageway 183 having a valve seat 184 at its lower end. The passageway 183 communicates fluidically with the casing 26 thereabove through a duct 185 provided in the cement block. The cage has a fluid passage 186 at the bottom. A plurality of upstanding arcuately spaced ribs 187 is provided at the bottom of the cage, and a ball valve 188 is seen, in FIG. 3, resting on the ribs. Fluid may flow downwardly through the float collar 175, passing through the passages 185, 183 and 186, and flowing past the ball valve 188 through the spaces between the ribs 187. Upward flow of fluid through the float collar will be stopped by the seating of the valve ball 188 on th valve seat 184 (see FIG. 4C).

Referring further to FIG. 3C, a length of casing 26 is threaded at 189 into the casing collar 179, previously referred to, and extends to a depth near the bottom 191 of the well 21. A cement float shoe 192 is secured to the bottom of the casing 26 by a threaded connection 193. This float shoe is similar in construction and operation to the float collar 175 described in the immediately preceding paragraph. From a consideration of FIG. 3C taken with the foregoing description, it will be apparent that fluid can flow down through the float shoe 192 and out into the well bore, but that return flow from the well bore up through the float shoe into the casing will be prevented by the seating of the ball valve 194 on the valve seat 195.

Turning now to FIG. 7, the plug stack assembly 27 is seen in quarter section. In this view, the rubber flanges 99 and 124 of the shut-off plug 64 and the first-stage cementing plug 67, respectively, are shown in their unflexed condition. It will also be seen that the trip-plug 66 is provided with circumferentially spaced, longitudinal grooves 196 on the outer surface of the body portion 107 which facilitate the fall of this plug through a column of liquid in the well casing 26.

As seen in FIG. 7, the plug stack assembly 27 is fitted with a discoid assembly plate 197 overlying the bushing 91 and the bell 94 of the shut-off plug 64. The assembly plate has a central hole 198 through which a tie rod 199 extends. The end 201 of the tie rod is threaded and fitted with a complementarily threaded nut 202. Another discoid assembly plate 203 is disposed at the other end of the plug stack assembly in abutting relation to the free end of the nose piece 119. The assembly plate 203 has a central hole 204 through which the other end 205 of the tie rod 199 projects, such other end being threaded and fitted with a nut 206.

The plug stack assembly may be put together in the following manner. The plugs 64, 66 and 67 and the bushing 91 initially do not have holes for the shear pins 95, 112 and 110. The bushing 91 with its O-ring 96 is fitted into the bell portion 94 of the shut-off plug 64. The reduced diameter portion 111 of the shut-off plug 64 with its O-ring 113 is inserted into the bell 108 of the trip-plug 66, with the annular surface 207 on the shut-off plug in abutment with the cooperating annular surface 208 on the trip-plug. Then, the nose portion 109 of the trip-plug 66, with its O-ring 100 is inserted into the bell 117 of the first-stage cementing plug 67. The cooperating annular surfaces 209 on the trip-plug and 211 on the first-stage cementing plug 67 are placed in abutting relation. Thereafter, the tie rod 199 is disposed through the assembly of plugs, the assembly plates 197 and 203 are placed on the tie rod, and the nuts 202 and 206 are threaded on the ends of the tie rod and tightened to hold the assembly together. Thereafter, the holes for the shear pins 95, 112 and 110 are drilled, and the shear pins inserted in the respective holes.

Figure 11:
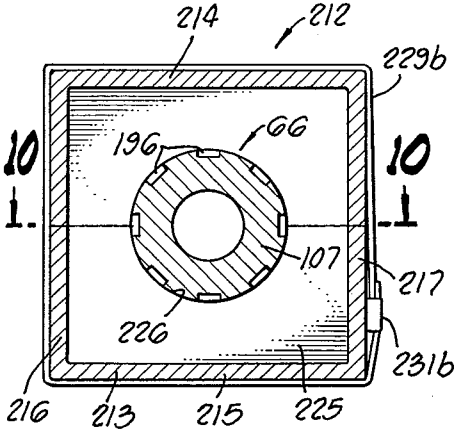
FIG. 11 is a sectional view taken along the line 11—11 of FIG. 10 and looking in the direction of the arrows.
Figure 10:
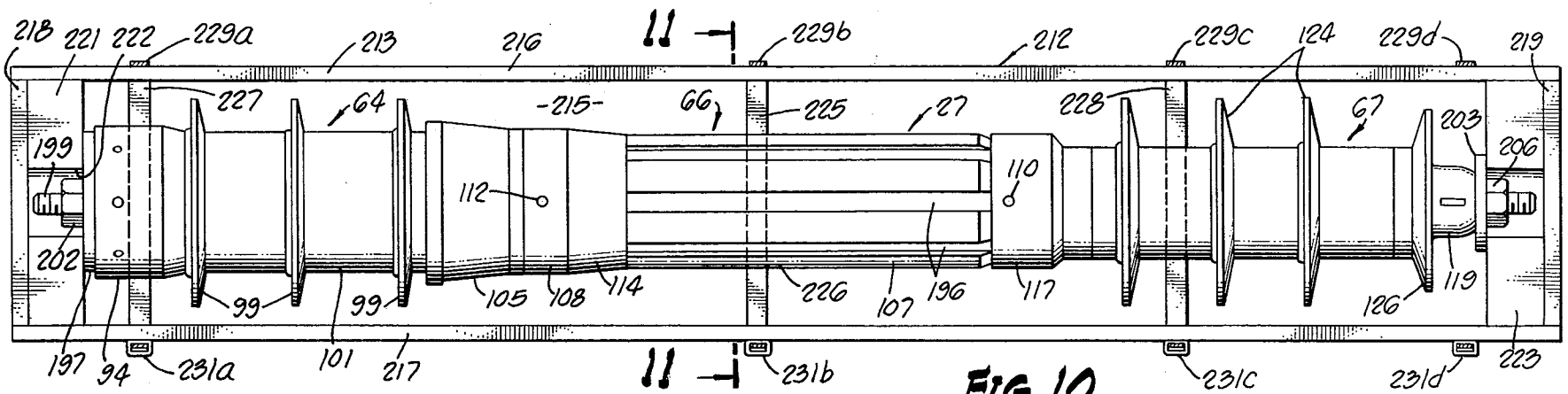
FIG. 10 is a longitudinal sectional view taken along the line 10—10 of FIG. 11 of a crated plug stack assembly of the invention, the plug stack being shown in elevation.

As shown in FIGS. 10 and 11, the completed plug stack assembly 27, for purposes of storage or shipment, is packed in a crate designated by the general reference numeral 212. The crate has a lower half 213 and an upper half 214. Only the lower half need be described, as the upper half is identical to it. The lower half has an elongated rectangular bottom panel 215 and two opposed upstanding side panels 216 and 217, integral with or suitably joined to the bottom panel. End panels 218 and 219 are provided for the lower half of the crate. A spacer 221 is located in the left end of the lower half of the crate, as seen in FIG. 10. This spacer abuts the assembly plate 197 of the plug stack assembly, and prevents the latter from moving to the left. A notch 222 is cut in the spacer to accommodate the end of the tie rod 199 and the nut 202. A similar spacer or end support member 223 is provided at the right-hand end of the lower half of the crate to contact the assembly plate 203 and prevent the stack assembly from moving to the right. A notch 224 is provided in the spacer to receive the end of the tie rod and the nut 206.

A central bulkhead 225 is mounted between the bottom panel 215 and the side panels 216 and 217. This bulkhead has a semicircular notch 226 contoured to the trip-plug 66 to cradle the latter. A similar bulkhead 227 supports the bell 94 of the shut-off plug 64. In like fashion, another bulkhead 228 is arranged to support the first-stage cementing plug 67.

The upper half 214 of the crate is placed on the lower half 213, as seen in FIG. 11, and a number of steel bands *229a*, *229b*, *229c* and *229d* are passed about the crate, tightened, and fastened by buckles **231*a*, 231*b*, 231*c* and 231*d***.

It will be understood that the tie rod means holds the plug stack in compression and keeps the shear pins substantially free from stresses. The crate 212, with its bulkheads and spacers, supports the plug stack assembly in a manner to prevent bending and longitudinal shifting of the plug stack assembly, thereby further protecting the shear pins from damage. It will also be understood that the tie rod means is removed from the plug stack assembly before the assembly is fitted to the lower section 63 of the plug launching mandrel in preparation for a stage cementing operation.

Figure 8:
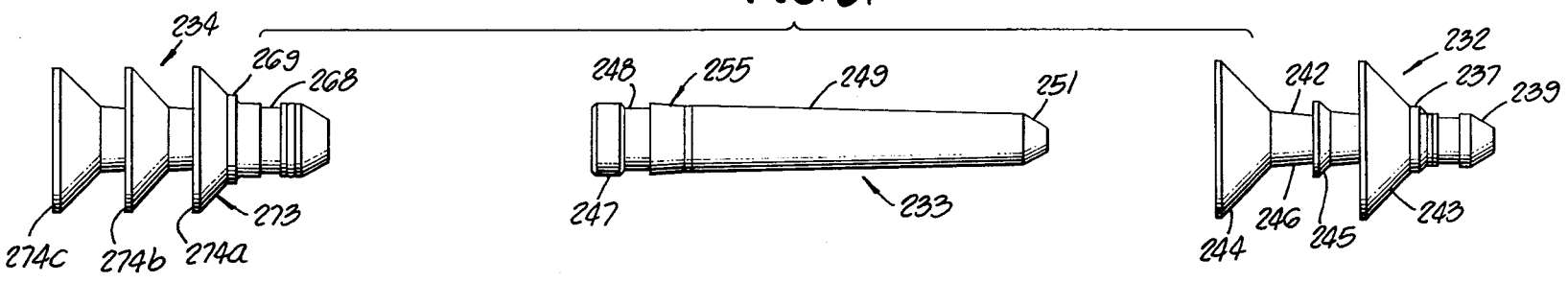
FIG. 8 is an elevational view of actuators for the plugs of the plug stack assembly of FIG. 7.

Actuators or plug closure devices for the several plugs of the plug stack assembly 27 are illustrated in FIG. 8, to which reference is now made. The actuator for the firststage cementing plug 67 is designated by the general reference numeral 232, that for the trip-plug 66 by the general reference numeral 233, and that for the shut-off plug 64 by the general reference numeral 234.

Figure 4A:
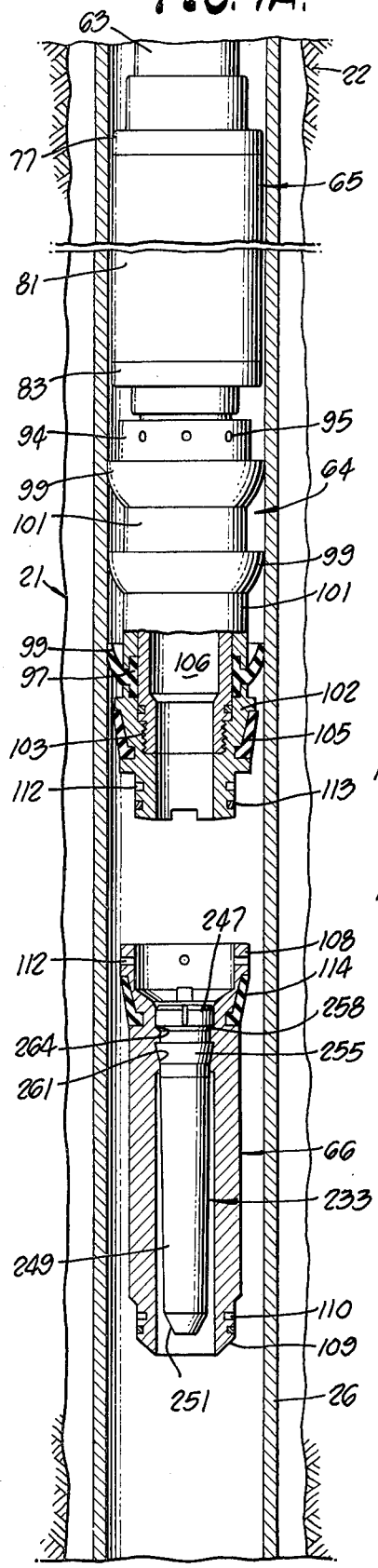
FIGS. 4A, 4B and 4C are, respectively, views similar to the views of FIGS. 3A, 3B and 3C, but subsequent to the placement of the first stage of cement slurry.
Figure 4B:
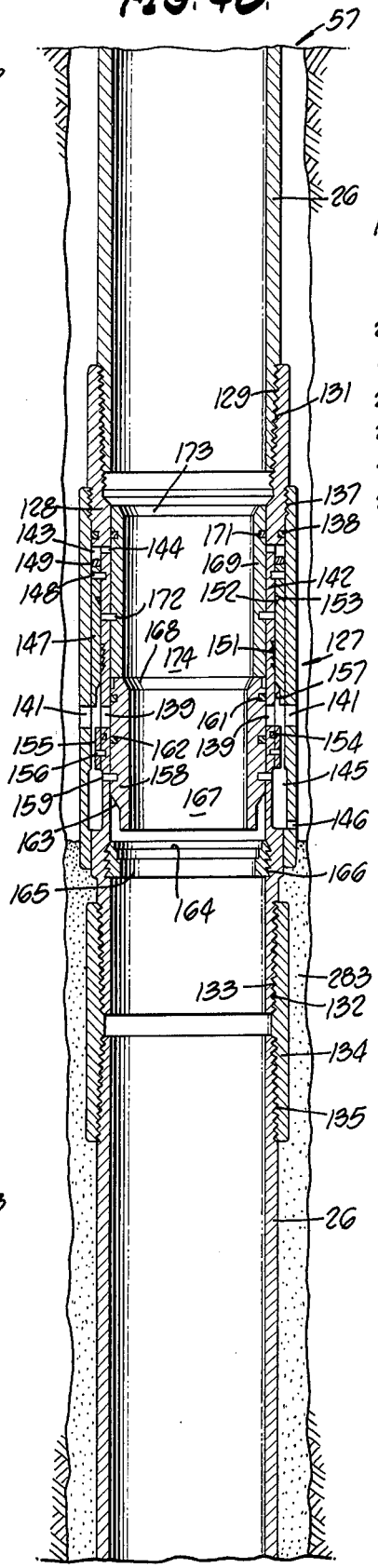
Figure 4C:
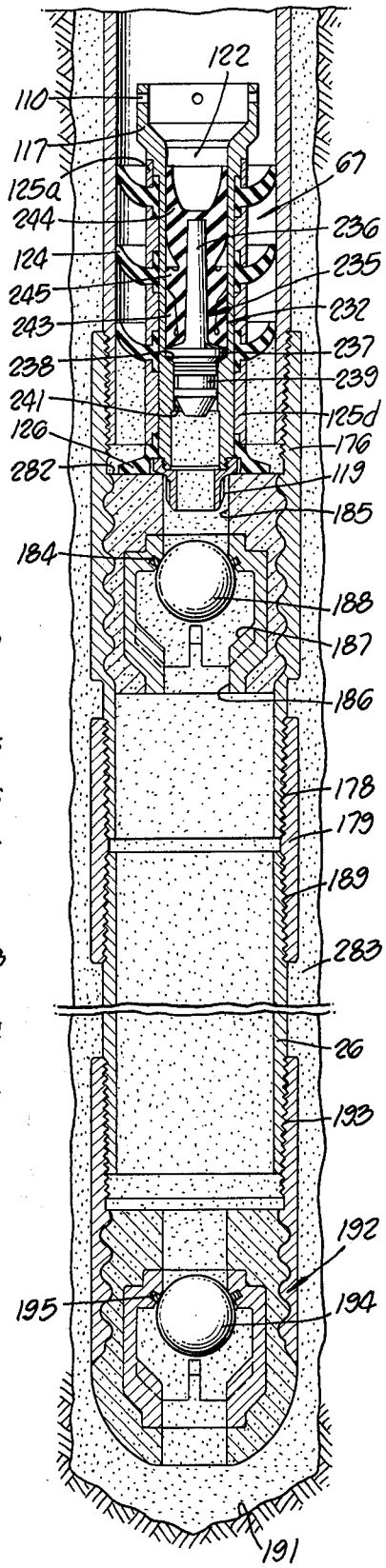

The actuator 232 is shown in side elevation in FIG. 8 and takes the form of a dart. In FIG. 4C, the dart is shown in longitudinal section and seated in the bore of the firststage cementing plug 67. The dart has a metal body 235, preferably formed of an easily drillable metal such as aluminum or magnesium alloy. The body has a shank 236, a flange 237 adapted to enter the bore 122 of the plug 67 and to become seated upon a seat 238 provided in the bore 122, and a nose portion 239 adapted to be received with a close sliding fit in a reduced diameter section 241 of the bore to maintain the dart aligned with the plug 67 when the dart seated. A unitary, elastomeric outer portion 242 is bonded to the shank 236. The outer portion has a forward wiper cup 243 adjacent to the flange 237 and a rear wiper cup 244 at the back. Intermediate the wiper cups 243 and 244 is a seal cup 245 having a substantially smaller diameter than the wiper cups. The wiper cups and the seal cup extend outwardly and rearwardly from a longitudinal portion 246 of the elastomeric outer portion 242.

The wiper cups have equal diameters somewhat larger than the inside diameter of the drill pipe string 33 and are adapted to form a good running seal with the inner walls of the drill pipe string and to wipe these inner walls when pumped down the drill pipe string as described hereinafter. These wiper cups will also enable the dart to be pumped through the bores of the universal running tool 53, the mandrel sections 59 and 63, and the plugs 64 and 66 to wipe these bores. When the dart is seated in the first-stage cementing plug 67, the bore 122 of which has a smaller diameter than the bore of the drill pipe string 33, the wiper cups are folded back to such an extent that they become fluted like a folded umbrella and do not provide a very effective seal with the bore 122 of the first-stage cementing plug. The seal cup 245 has a diameter somewhat greater than the diameter of the bore 122, and is adapted to be slightly compressed in the bore without being distorted sufficiently to become fluted; in this way the seal cup 245 forms an effective seal with the bore 122. As seen in FIG. 4C, the seal cup 245 is spaced rearwardly from the root of the forward wiper cups 243 far enough to allow the forward wiper cup to collapse into the longitudinal rubber portion 246 without substantially overlapping the seal cup 245 and without breaking the seal between the latter and the bore 122. As exemplary of the dimensions involved: where the inside diameter of the drill pipe 33 is $3\frac{5}{8}$ inches and the inside diameter of the bore 122 of the first-stage cementing plug is 2 inches, the outside diameter of the wiper cups 243 and 244 may be $4\frac{3}{4}$ inches and the outside diameter of the seal cup 245 may be $2\frac{1}{4}$ inches.

Figure 9:
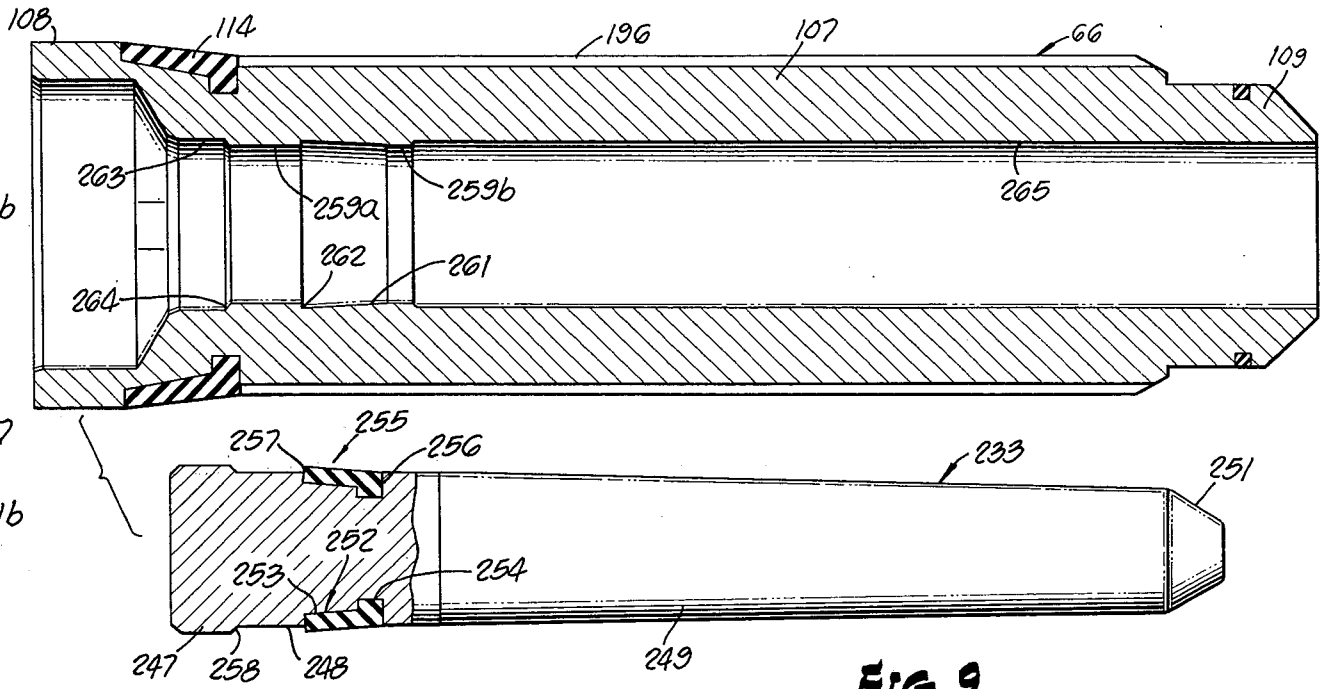
FIG. 9 is an axial sectional view, partly in elevation, of a trip plug in accordance with the invention.

The actuator 233 for the trip-plug 66 and its manner of cooperation with the trip plug will be described with reference to FIGS. 8, 9 and 4A. Referring particularly to FIG. 9, the trip-plug 66 is shown prior to the drilling therein of holes for the shear pins 110 and 112, previously mentioned. The body portion 107 is tubular and is adapted to receive the actuator 233 within its bore, as shown in FIG. 4A. The actuator has a head 247, a shank 248, a downwardly tapering portion 249, and a truncated conical nose 251. The shank 248 is provided with an annular sealing ring groove 252 of L-shaped cross section. The upright portion 253 of the groove tapers downwardly to meet the deeper cut horizontal portion 254 of the groove. A rubber or elastomeric sealing ring 255, of conforming L-shaped cross section is disposed within the groove 252. The bottom 256 of the sealing ring has the same outside diameter as the shank 248, and its flares upwardly and outwardly to form a shoulder 257 that extends outwardly from the shank. At the bottom of the head 247, there is provided a shoulder 258 that tapers inwardly to intersect the shank 248.

The bore of the trip-plug 66 has a reduced diameter section **259*a*, 259*b* adapted to slidingly receive the shank 248 of the actuator 233 and to align the actuator with the bore of the trip plug. Within the reduced diameter section is provided a downwardly tapering groove 261 having a downwardly facing shouler 262 at the top. A counterbore 263 is provided above the reduced diameter section 259*a* and an upwardly facing, tapered shoulder 264 is formed between the counterbore and the reduced diameter section 259*a*. The bore of the trip plug has an enlarged cylindrical section 265 extending from the reduced diameter section 259*b* to the bottom of the plug. When the actuator 233 is inserted into the bore of the trip-plug 66 from the top, as seen in FIG. 4A. the head 247 is received in the counterbore 263 with the shoulder 258 abutting the shoulder 264 to stop downward movement of the actuator. The rubber sealing ring 255 is received in the tapered groove 261 to seal thereagainst while the shoulder 257 at the top of the sealing ring underlies the shoulder 262 at the top of the groove to retain the actuator in the bore of the plug so that it cannot be removed upwardly. The tapered portions 249 and 251 of the actuator project into the cylindrical section 265** of the bore.

The trip-plug 66 and the actuator 233 may be made of cast iron, which has a relatively high specific gravity, yet is readily drillable. The high specific gravity of the actuator 233 enables it to fall reasonably rapidly through liquid in the drill pipe string, and the high specific gravity of the combined trip-plug and actuator provide a rapid rate of fall through liquid in the casing, as will be described hereinafter. The easy drillability of the trip-plug and its actuator make it easy to remove these elements by drilling them from the casing following the cementing operation.

Figure 6A:
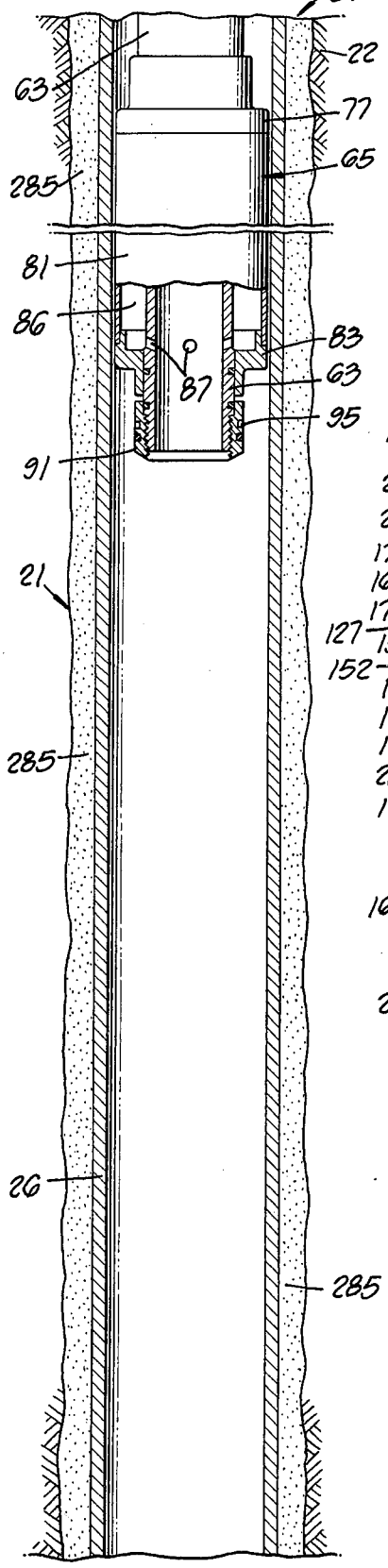
FIGS. 6A, 6B and 6C are, respectively, views similar to those of FIGS. 5A, 5B and 5C, but subsequent to the placement of the second stage of cement slurry.
Figure 6B:
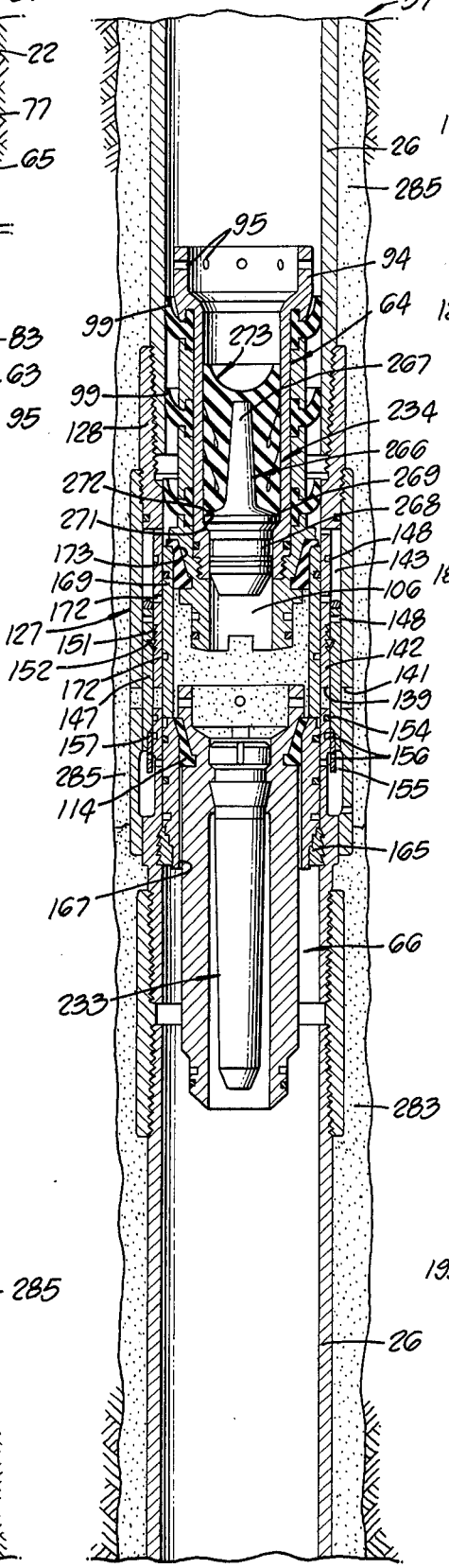
Figure 6C:
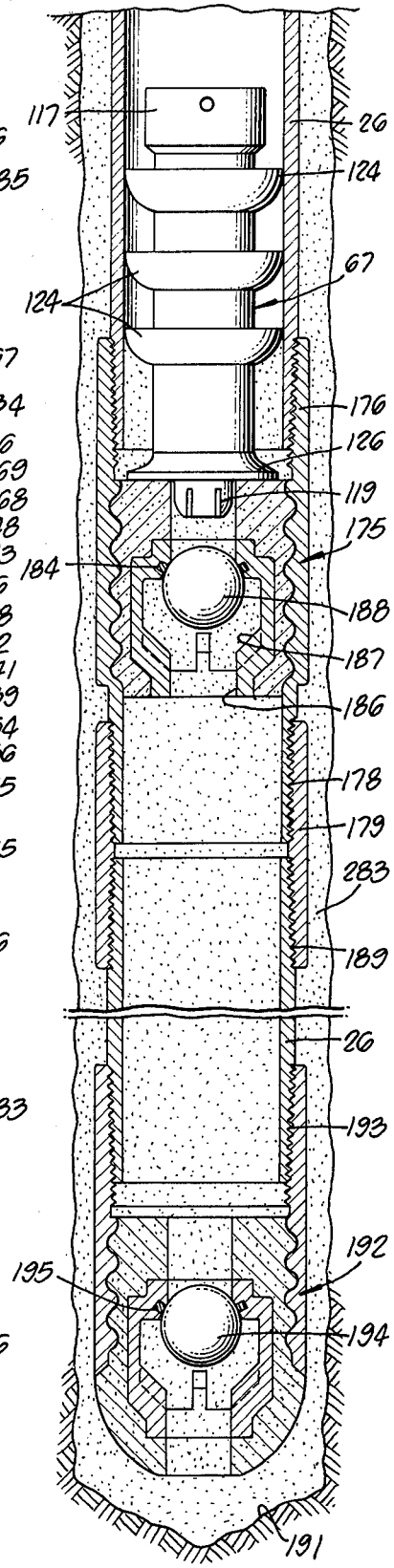

The actuator or closure member 234 for the shut-off plug 64 is shown in side elevation in FIG. 8 and in longitudinal cross section in FIG. 6B. The actuator has a body 266 of an easily drillable metal, such as magnesium alloy. The body has a shank 267 and a nose portion 268, slidably received in the axial passage 106 of the shut-off plug 64. A flange 269 on the body has a downwardly facing shoulder 271 that abuts a shoulder 272 in the axial passage 106 to limit downward movement of the actuator. A rubber or elastomeric cup assembly 273 is molded about and bonded to the shank 267 and the upper surface of the flange 269. Upwardly and outwardly flaring cups **274*a*, 274*b* and 274*c* are provided, these being of a diameter adequate to wipe the interior of the drill pipe string 33 as it is pumped downwardly therein, and adequate to seal the axial passage 106 of the shut-off plug 64 when it has come to rest therein, as seen in FIG. 6B**.

Referring to FIG. 2, the actuator launching head 34 has an elongated cylindrical chamber 275 that communicates downwardly with the bore of the drill pipe string 33. An easily removable cap 276 is threaded on the top of the head. A pipe fitting 277 is provided in the side of the launching head and is connectible to a pumping system (not shown) for pumping various fluids into the head and down the drill pipe string. An actuator, such as the actuator 232 is introduced into the top of the chamber 275 with the cap 276 removed, the cap then being replaced. The actuator is releasably retained in place by a pin detent 278 slidable in a cylinder 279 and retractable by a handle 281 to release the actuator to permit it to drop into the liquid in the chamber 275. Any suitable launching head may be used, such as one that accommodates three-plug actuators at one time.

The operation of the stage cementing equipment of the invention will now be described. The equipment is assembled and positioned in the well as shown in FIGS. 1, 2, 3A, 3B and 3C.

The liquid pumping system is connected to the pipe fitting 277, and the well may be conditioned for cementing as by pumping a clear conditioning fluid down the drill pipe string and plug stack assembly, down the casing string, out through the float shoe and up the annulus and riser pipe to flush drilling mud from the well.

Next, a first stage of cement slurry, the volume of which has been calculated to fill the well annulus from the bottom of the hole to a level just below the stage cementer ports 139, 141 is pumped down the drill pipe casing followed by displacing fluid which may be water. As the tail end of the first stage of cement slurry passes through the actuator lauching head 34, the latch 278 is retracted to release the actuator dart 232 which, being driven by the displacing fluid behind it, follows the first stage of cement slurry down the string of drill pipe 33, and, as it travels, wiping the inner walls of the drill pipe free from cement slurry. The actuator or dart 232 is of such a size that it passes through the opening in the universal running tool, through the mandrel 58, through the axial passage 106 in the shut-off plug 64, through the passage 115 of the trip-plug, and seats on the seat 238 in the bore 122 of the first-stage cementing plug to close the bore therethrough, as previously described. The pressure pulse induced in the displacing fluid behind the actuator 232 when it suddenly seats is cushioned by the compression of air in the surge chamber 65, so that the first-stage cementing plug is not jarred loose from the trip-plug 66. The pump pressure on the displacing liquid is increased to a value at which the shear pins 110 are sheared to release the first-stage cementing plug from the trip-plug. The trip-plug with its actuator are displaced down the casing string by the further pumping of displacing fluid until the first-stage cementing plug comes to rest on the float collar 175, as seen in FIG. 4C. In this position, the flange member 126 of the first-stage cementing plug seals against the top surface 282 of the float collar. This causes an increase in pump pressure, which indicates that the first stage of cement slurry 283 has been displaced into the well annulus, as seen in FIGS. 4C and 4B. The rubber flanges 124 of the first-stage cementing plug in moving down the casing string will have wiped the bore of the casing string clear of cement slurry. The pumps may now be stopped, whereupon the ball valves 188 and 194 will be moved into contact with their respective seats 184 and 195 to prevent any appreciable reverse flow of cement slurry from the well annulus back into the casing string, and to maintain the firststage of cement slurry in position in the annulus until it sets.

A second stage of cement slurry may then be emplaced in the well annulus above the first-stage of cement. It is first necessary to open the stage cementing ports 139, 141 from the closed condition, as shown in FIGS. 3B and 4B, and to plug the bore of the casing below these ports. To accomplish this, the trip-plug actuator or trip-plug bar 233 is dropped through the actuator launching head 34 into the column of displacing fluid in the drill pipe string and the casing. The bar gravitates through the static column of displacing fluid in the drill pipe string, down through the plug launching mandrel 58, down through the axial passage 106 of the shut-off plug 64, and into the passage 115 of the trip-plug 66. Pump pressure is then applied to the displacing liquid to seat the trip-plug bar in the trip-plug with the shoulder 258 of the head 247 abutting the shoulder 264 in the trip-plug and the sealing ring 255 in sealing relation to the downwardly tapering groove 261, as previously described, to thereby close the passage 115. Pump pressure is increased sufficiently to break the shear pins 112 and release the trip-plug 66 with its actuator 233 from the shut-off plug 64, as shown in FIG. 4A.

Figure 5A:
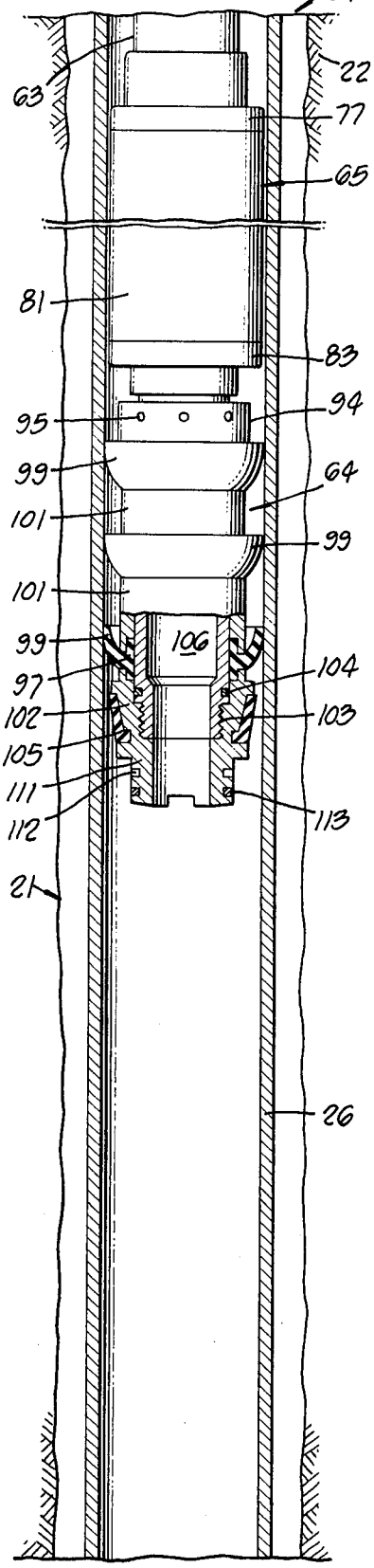
FIGS. 5A, 5B and 5C are, respectively, views similar to those seen in FIGS. 4A, 4B and 4C, but with the stage collar conditioned for the placement of the second stage of cement slurry.
Figure 5B:
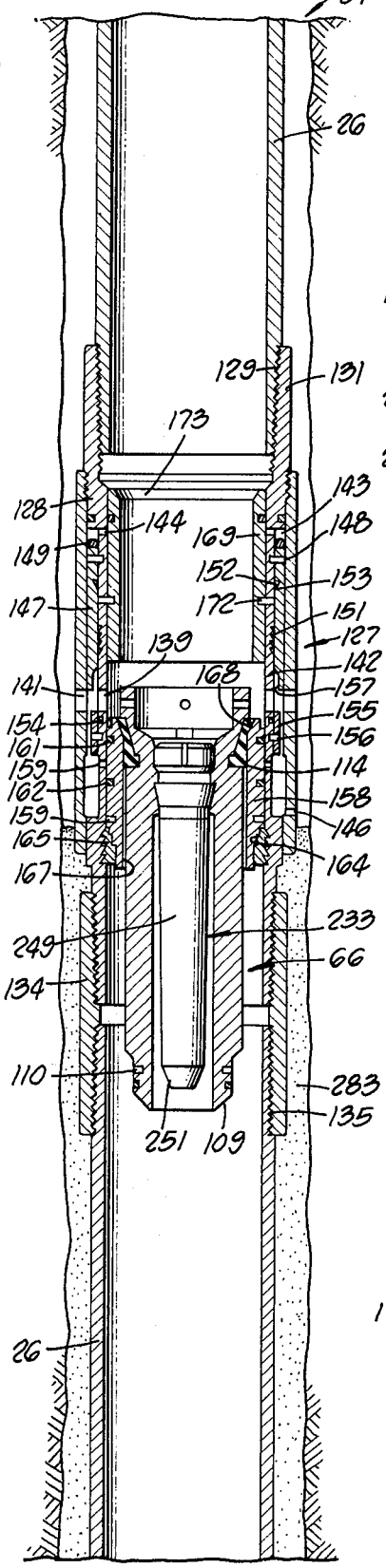
Figure 5C:
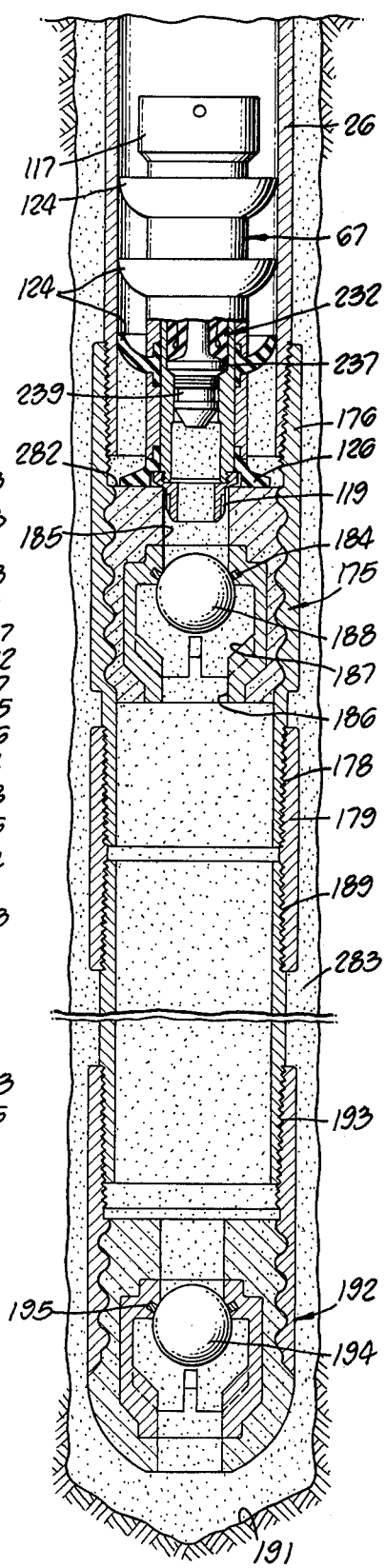

When the grip-plug and its actuator have been launched as aforesaid, the pumps are stopped, and the trip-plug and its actuator are permitted to fall as a unit through the displacing fluid in the casing string into the lower sleeve 158 of the stage cementing collar 127; see FIG. 5B. The trip-plug is stopped in the lower sleeve when the tapered sealing ring 114 of the trip-plug is received on the chamfered surface 168 or seat at the top of the lower sleeve, thereby closing the bore 167 through the lower sleeve. Pump pressure is applied to the displacing fluid to break the shear pins 159 and allow the lower sleeve to move down to the position shown in FIG. 5B to open the stage cementing ports 139 and 141. When the ports have been opened, the pumps are stopped.

The required volume of a second stage of cement slurry is now pumped into the actuator launching head 34 through the fitting 277, followed by a second stage of displacing fluid, which may be water. The actuator 234 for the shut-off plug 64, the actuator previously having bee loaded into the actuator launching head, is released into the interface between the second stage of cement slurry and the second stage of displacing fluid which follows it. Pumping is continued to drive the actuator 234 down the drill pipe string 33, through the passage 284 in the universal launching tool 53, down through the mandrel 58 and into the axial passage 106 of the shut-off plug 64. The actuator 234 lands on the shoulder 272 in the passage 106 of the shut-off plug, thereby closing the passage. The shock pulse setup in the second stage of displacing fluid when the actuator seats on the shoulder 272 is cushioned in the surge chamber 65. Pump pressure is increased to break the shear pins 95 and separate the shut-off plug 64 from the bushing 92, which remains attached to the lower mandrel section 63, as seen in FIG. 6A.

The shut-off plug actuactor 234, as it is pumped down the drill pipe string 33, separates the second displacement fluid from the second stage of cement slurry. This actuator also wipes the interior walls of the drill pipe string to remove cement slurry therefrom.

After the shut-off plug 64 with its actuator have been launched from the mandrel 58, pumping is continued to drive the second stage of cement slurry 285 down the casing and out through the ports 139,141 in the stage cementing collar and into the well-casing annulus 57 above the first stage cement 283. The shut-off plug acts as a piston which is moved by the second displacement fluid and which drives the second stage of cement slurry ahead of it. In moving down the casing, the rubber cups 97 of the shut-off plug wipe the interior walls of the casing. Fluid is returned to the surface from the annulus 21 through the grooves 56 in the universal running tool 53 and through the riser pipe 28.

When the shut-off plug reaches the stage cementing collar 127, the second stage of cement slurry will have been emplaced in the annulus 57. The shut-off plug then functions the upper sleeve to close the cementing ports 139,141. These ports are shown in the open position in FIG. 5B and in the closed position in FIG. 6B. The shut-off plug lands in the upper sleeve 169 of the stage cementing collar, the sealing ring 105 of the shut-off plug sealing against the chamfer 173 of the sleeve. Pump pressure is increased to shear the shear pins 172 and move the upper sleeve downward to abut the lower sleeve 158 and close the ports 139,141, as seen in FIG. 6B.

A further increase in pump pressure moves the shut-off sleeve 147 from the position shown in FIG. 5B down to the position shown in FIG. 6B to permanently close the ports 139, 141 so that they will remain closed after the bore of the stage cementing collar has been drilled out. This is effected by increasing the pump pressure so that the hydraulic pressure in the annular cylindrical chamber 143 produces a downward force on the shut-off sleeve sufficient to break the shear pins 148 and allow the shut-off sleeve to be moved to its lower position as seen in FIG. 6B. In moving downwardly, the shut-off sleeve contacts the retainer sleeve 155, breaking the shear pins 156, and moving the retainer sleeve from its FIG. 5B position to its FIG. 6B position. The O-ring 154 is thereby uncovered and immediately thereafter is covered by the shut-off sleeve to seal the latter to the central portion 142 of the stage cementing collar 127. The counterbore 157 in the bottom of the shut-off sleeve enables the shut-off sleeve to easily ride over and seal against the O-ring 154. The shut-off sleeve is held in its port-closing position by engagement of the split detent ring 152 in one of the ratch notches 151.

When the ports 139,141 have been closed, the second stage of cement is allowed to set in the annulus 57. The universal running tool 53 and drill pipe string 33 are unscrewed from the casing hanger body 54 and retrieved through the riser pipe 28. Thereafter, the stage cementing collar 127, the cement float collar 175, and the cement float shoe 192 may be drilled through, and further operations conducted in the well.

It will be understood that the shear pins 110 releasably retaining the first-stage cementing plug 67 on the trip-plug are designed to part and release the first-stage cementing plug in response to a force substantially less than the force needed to part the shear pins 112 and effect launching of the trip-plug 66. In turn, the force required to break the shear pins 112 is substantially less than that which is effective to part the shear pins 95 that releasably retain the shut-off plug 64 on the bushing 91. Accordingly, the first-stage cementing plug 67 can be launched without breaking the shear pins 112 and 95. Then, the trip-plug 66 can be launched without breaking the shear pins 95. Thereafter, the shut-off plug can be launched.

Releasable devices other than shear pins may be employed for releasably mounting one or more of the plugs in the plug stack assembly 27. For example, and without limitation thereto, a double collet release mechanism, such as that disclosed in U.S. Pat. No. 3,915,226, issued Oct. 28, 1975, Ronald E. Savage, could be used in lieu of shear pins.

Moreover, actuators or closure members, other than those shown in FIG. 8, may be substituted for the actuators specifically disclosed. Actuators, such as solid or elastomeric balls, may be employed to advantage.

It is especially advantageous to use a drop bar or gravity type actuator, such as the drop bar 233, to launch the trip-plug, because the drop bar can be used long after the first stage of cement has been emplaced in the annulus. However, a dart or other pump-down closure member may be used instead of the drop bar to launch the trip-plug, provided it is timed to land in and launch the trip-plug just before the first-stage cementing plug closes the opening 185 in the float collar 175.

Although the present invention is particularly adapted for stage cementing marine wells, it may also be used for stage cementing land based wells.

The foregoing description sets forth the best mode contemplated by the inventor of carrying out his invention. However, various modifications will occur to those skilled in the art in the light of the foregoing description without departing from the spirit and scope of the invention as defined in the claims.

I claim:

1. A plug stack assembly for use in stage cementing a well casing string in a well bore comprising:

A. a shut-off plug receivable in the well casing string;

B. first releasable means for connecting said shut-off plug to a mandrel inserted in the well casing string, said mandrel having a longitudinal passage for the flow of cementing fluids therethrough;

C. a trip-plug receivable in the well casing string;

D. second releasable means connecting said trip-plug directly to said shut-off plug;

E. a first-stage cementing plug receivable in the well casing string;

F. third releasable means connecting said first-stage cementing plug directly to said trip-plug;

G. means defining a passage through each plug for the flow of cementing fluids from the longitudinal passage of the mandrel into the well casing string;

H. said first-stage cementing plug having means cooperative with a first closure member in said cementing fluid to close the passage in said first-stage cementing plug and effect release of said thid releasable means responsive to cementing fluid pressure;

I. said trip-plug having means cooperative with a second closure member in said cementing fluid to close the passage in said trip-plug and effect release of said second releasable means responsive to cementing fluid pressure; and J. said shut-off plug having means cooperative with a third closure member in said cementing fluid to close the passage in said shut-off plug and effect release of said first releasable means responsive to cementing fluid pressure.

2. A plug stack assembly as defined in claim 1 comprising first seal means for sealing said first-stage plug to said trip-plug, second seal means for sealing said trip-plug to said shut-off plug, and third seal means for sealing said shut-off plug to said mandrel.

3. A plug stack assembly as defined in claim 1, wherein said releasable means comprise shear pin means.

4. A plug stack assembly as defined in claim 1, including draw bolt means extending through the passages in the plugs for applying a compressive force to the plug stack assembly.

5. A plug stack assembly as defined in claim 1, wherein said shut-off plug and said first-stage cementing plug each has flexible, annular wiper means extending outwardly therefrom and adapted to wipe the well casing string, and said trip-plug has a smaller diameter than the well casing string and is adapted to gravitate through cementing fluid in the well casing string.

6. A plug stack assembly as defined in claim 5, wherein said trip-plug has longitudinal groove means spaced circumferentially about its exterior.

7. The combination with a plug stack assembly as defined in claim 1 of a crate having support means cradling said stack assembly and opposing bending stresses therein.

8. The combination as defined in claim 7, wherein said crate has support means contacting said stack assembly and opposing axial stresses therein.

9. In a subsea well installation including:

A. a composite well casing string suspended within a subsea well bore from a casing hanger supported by a subsea well head, said composite well casing string being adapted to be connected through running tool means and a string of drill pipe to hoisting and cementing equipment disposed adjacent to the surface of the sea above the well head;

B. said composite well casing string having a. first-stage cementing port means for communicating the interior of said composite string with the exterior and adapted to be closed by a first-stage cementing plug; and b. initially closed, but openable and closeable second-stage cementing port means for communicating the interior of said casing string with the exterior, said second-stage cementing port means being disposed above said first-stage cementing port means and below the top of said casing string and adapted to be opened by a trip-plug and closed by a shut-off plug;

C. a mandrel extending longitudinally into the well casing string and providing a longitudinal passage in fluid communication with the string of drill pipe;

D. a shut-off plug in the well casing string and adapted to close said second-stage cementing port means;

E. first releasable means connecting said shut-off plug to said mandrel;

F. a trip-plug in the well casing string and adapted to open said second-stage cementing port means;

G. second releasable means connecting said trip-plug directly to said shut-off plug;

H. a first-stage cementing plug in the well casing string and adapted to close said first-stage cementing port means;

I. third releasable means connecting said first-stage cementing plug directly to said trip-plug;

J. means defining a passage through each plug for the flow of cementing fluids from the longitudinal passage of the mandrel into the well casing string;

K. said first-stage cementing plug having means cooperative with a first closure member in said cementing fluid to close the passage in said first-stage cementing plug and effect release of said third releasable means responsive to cementing fluid pressure to launch said first-stage cementing plug for travel down said casing string to close said first-stage cementing port means;

L. said trip-plug having means cooperative with a second closure member in said cementing fluid to close the passage in said trip-plug to effect release of said second releasable means responsive to cementing fluid pressure to launch said trip-plug for travel down said casing string to open said second-stage cementing port means; and M. said shut-off plug having means cooperative with a third closure member in said cementing fluid to close the passage in said shut-off plug and effect release of said first releasable means responsive to cementing fluid pressure to launch said shut-off plug for travel down said casing string to close said second-stage cementing port means.

10. In a subsea well installation as defined in claim 9, check valve means for preventing flow of liquid through said first-stage cementing port means from the exterior of said composite string of casing to the interior thereof.

11. In a subsea well installation as defined in claim 9, said releasable means comprising shear pin means.

12. In a subsea well installation as defined in claim 9, surge chamber means surrounding said mandrel, and fluid port means communicating said surge chamber means with the longitudinal passage of said tubular mandrel.

13. In a subsea well installation as defined in claim 9, swivel means in said tubular mandrel.

14. In a subsea well installation as defined in claim 9, said shut-off plug and said first-stage cementing plug each comprising flexible, annular wiper means extending outwardly therefrom into wiping engagement with the bore of said composite string of casing, and said trip-plug having a smaller diameter than said composite string of casing and being adapted to gravitate through cementing fluid in said string of casing.

15. In a subsea well installation as defined in claim 14, said trip-plug comprising longitudinal groove means spaced circumferentially about its exterior.

16. A method of stage cementing a composite string of well casing within a subsea well bore which comprises:

A. lowering into a subsea well bore a composite string of well casing having a. first-stage cementing port means for communicating the interior of said composite string with the exterior and adapted to be closed by first-stage cementing plug means, and b. initially closed, but openable and closeable tubular second-stage cementing port means for communicating the interior of said composite string with the exterior, said second-stage cementing port means being disposed above said first-stage cementing port means and adapted to be opened by trip-plug means and closed by shut-off plug means;

B. suspending said composite string in the well bore from a subsea casing hanger supported by a subsea well head;

C. inserting into said composite string above said second-stage cementing port means a plug stack assembly having a. tubular first-stage cementing plug means having a wiping fit with the walls of said composite string, b. tubular trip-plug means above said first-stage cementing plug means, and spaced from the walls of said composite string, c. means for mounting said first-stage cementing plug means on said trip-plug means in axial alignment therewith, including first releasable means responsive to downward force for releasing said first-stage cementing plug means from said trip-plug means, d. tubular shut-off plug means above said trip-plug means and having a wiping fit with the walls of said composite string, e. means for mounting said trip-plug means on said shut-off plug means in alignment therewith, including second releasable means responsive to downward force for releasing said trip-plug means from said shut-off plug means, f. an annular support member, g. means for mounting said shut-off plug means on said support member in axial alignment therewith, including third releasable means responsive to downward force for releasing said shut-off plug means from said support member, and h. said annular support member, said shut-off plug means, said trip-plug means and said first-stage cementing plug means defining a continuous, liquid-tight conduit;

D. mounting said support member against downward movement in said composite string;

E. connecting said support member through a string of drill pipe to cementing equipment adjacent to the surface of the sea above the subsea wellhead for the pumping of liquid through said string of drill pipe, through said conduit, and into said composite string;

F. pumping a first stage of cement slurry followed by a first actuator member and by displacing liquid through said drill pipe, said annular support member, said shut-off plug means, said trip-plug means and said first-stage cementing plug means until said first actuator member engages and plugs the bore of said first-stage cementing plug means;

G. continuing to pump displacing liquid to apply pressure to said first-stage cementing plug means with its bore so plugged to effect its release and displace it down said composite string, through said second-stage cementing port means, and into closing relation with said first-stage cementing port means to thereby displace said first stage of cement slurry out of said first-stage cementing port means into the annulus of the well bore and to block flow of liquid from said composite string through said first-stage cementing port means, and further to support a static column of liquid in said composite string and said drill pipe;

H. inserting a second actuator member into said drill pipe for movement down the drill pipe, through said annular support member and said shut-off plug means until said second actuator member engages and plugs the bore of said trip-plug means;

I. applying liquid pressure above said trip-plug means with its bore so plugged to effect its release;

J. permitting said trip-plug means with its bore so plugged to gravitate down the composite string into port-opening relationship with said second-stage cementing port means, said trip-plug means with its bore so plugged blocking the flow of liquid into the portion of said composite string below said second-stage cementing port means;

K. applying liquid pressure to said trip-plug means with its bore so plugged to open said second-stage cementing port means;

L. pumping a second stage of cement slurry followed by a third actuator member and by displacing liquid through said drill pipe and said annular support member until said third actuator member engages and plugs the bore of said shut-off plug means;

M. continuing to pump displacing liquid through said drill pipe to apply pressure to said shut-off plug means with its bore so plugged to effect its release and displace it down said composite string and into port-closing relation with said secod-stage cementing port means and to displace said second stage of cement slurry out of said second-stage cement port means into the well bore;

N. applying liquid pressure to said shut-off plug means with its bore so plugged to close said second-stage cementing port means; and O. allowing the cement slurry to set in the well bore.

17. A method of cementing a composite string of well casing within a subsea well bore as defined in claim 16, wherein said first, second, and third releasable means each comprise shear pins shearable responsive to downward force for releasing said respective plug means, the downward force required to shear the shear pins of said second releasable means being greater than the downward force required to shear the shear pins of said first releasable means, and the downward force required to shear the shear pins of said third releasable means being greater than the downward force required to shear the shear pins of said second releasable means.

18. A method of cementing a composite string of well casing within a subsea well bore as defined in claim 16, including drilling out obstructions within said casing.

19. A method of cementing a composite string of well casing within a subsea well bore a defined in claim 16, wherein said first actuator member and said third actuator member each comprise dart means having means for wiping the bore of said string of drill pipe.

20. A method of cementing a composite string of well casing within a subsea well bore as defined in claim 16, wherein said second actuator means comprises a cylindrical drop bar having a specific gravity substantially greater than unity.

21. A trip-plug for operating a stage cementing collar to open the ports thereof comprising:

A. an elongate vertically positionable body providing a liquid passage extending longitudinally therethrough and having a liquid inlet at the upper end and a liquid outlet at the lower end;

B. an actuator member insertable into said liquid passage through said inlet end and cooperable with said body for blocking the flow of liquid through said passage;

C. said actuator member and said body having a high specific gravity adapting them to gravitate through liquid of lower specific gravity disposed above said stage cementing collar.

22. A trip-plug as defined in claim 21, including means at the lower end of said body cooperable with partible means carried by a subjacent tubular cementing plug means for releasably mounting said cementing plug means on said body for liquid communication with said liquid passage.

23. A trip-plug as defined in claim 21, wherein said actuator member comprises a cylindrical drop bar that substantially fills said liquid passage when cooperating with said body for blocking the flow of liquid through said liquid passage.

24. A trip-plug as defined in claim 21, including cooperable stop members on said body and on said actuator member into said liquid passage at a position to block the flow of liquid therethrough.

25. A trip-plug as defined in claim 24, including sealing elements on said body and on said actuator member, said sealing elements being mutually cooperable, when said actuator member is at said position, for effecting a static seal against the passage of liquid between said body and said actuator member.

26. A trip-plug as defined in claim 25, including cooperable latch elements on said body and on said actuator member, said latch elements being engageable when said actuator member is at said position for preventing upward removal of said actuator member from said body.

27. A dart adapted to enter the bore of a hollow plug to block the flow of liquid through the bore which comprises:

an elongate body, at least one annular flexible wiping element extending transversely from said body, and an annular flexible sealing member extending transversely from said body and adapted to seal the dart in the bore of a hollow plug to block the flow of liquid therethrough, said at least one wiping element having a diameter larger than the diameter of said sealing member, wherein said sealing member is spaced longitudinally from said at least one flexible wiping element so that said wiping element may be folded in against said body free from substantial engagement with said sealing member, and said at least one flexible wiping element is located forwardly of said sealing member in the direction in which said dart enters the bore of the hollow plug.

28. A dart as defined in claim 27 comprising another annular flexible wiping element extending transversely from said body and having a diameter substantially the same as the diameter of said at least one wiping element, said another annular wiping element being located rearwardly of said sealing member.

* * * * *